US005906710A

United States Patent [19]

Trokhan

[11] Patent Number: 5,906,710

[45] Date of Patent: May 25, 1999

[54] PAPER HAVING PENNINSULAR SEGMENTS

[75] Inventor: Paul Dennis Trokhan, Hamilton, Ohio

[73] Assignee: The Procter & Gamble Company, Cincinnati, Ohio

[21] Appl. No.: 08/880,500

[22] Filed: Jun. 23, 1997

[51] Int. Cl.[6] ..... D21H 15/02

[52] U.S. Cl. ..... 162/109; 162/116; 162/117; 428/170; 428/195; 428/131

[58] Field of Search ..... 162/109, 111, 162/117, 116, 200; 428/152, 153, 195, 156, 174, 170, 131, 137, 138, 166; 442/33

[56] References Cited

U.S. PATENT DOCUMENTS

| | | | |
|---|---|---|---|
| 4,514,345 | 4/1985 | Johnson et al. | 264/22 |
| 4,528,239 | 7/1985 | Trokhan | 428/247 |
| 4,529,480 | 7/1985 | Trokhan | 162/109 |
| 4,637,859 | 1/1987 | Trokhan | 162/109 |
| 5,073,235 | 12/1991 | Trokhan | 162/199 |
| 5,245,025 | 9/1993 | Trokhan et al. | 536/56 |
| 5,275,700 | 1/1994 | Trokhan | 162/358.1 |
| 5,277,761 | 1/1994 | Van Phan et al. | 162/109 |
| 5,328,565 | 7/1994 | Rasch et al. | 162/113 |
| 5,334,289 | 8/1994 | Trokhan et al. | 162/358.2 |
| 5,364,504 | 11/1994 | Smurkoski et al. | 162/116 |
| 5,527,428 | 6/1996 | Trokhan et al. | 162/116 |
| 5,534,326 | 7/1996 | Trokhan et al. | 428/131 |
| 5,556,509 | 9/1996 | Trokhan et al. | 162/111 |
| 5,624,790 | 4/1997 | Trokhan et al. | 430/320 |
| 5,628,876 | 5/1997 | Ayers et al. | 162/358.2 |

FOREIGN PATENT DOCUMENTS

WO 96/00812 1/1996 WIPO .

*Primary Examiner*—Stanley S. Silverman
*Assistant Examiner*—Jose A. Fortuna
*Attorney, Agent, or Firm*—Larry L. Huston; E. Kelly Linman; Jacobus C. Rasser

[57] ABSTRACT

A papermaking belt and paper made thereon. The papermaking belt may be a through air drying belt having a plurality of deflection conduits therethrough. The deflection conduits are divided into subconduits by peninsular segments. Likewise, the paper made on the belt has an essentially continuous network and a plurality of domes. Each dome is divided into a plurality of subdomes by peninsular segments in the paper. The papermaking belt may, alternatively, be a forming wire. If so, the forming wire may have a plurality of discrete protuberances extending outwardly from the plane of the forming wire. Each protuberance has at least one slot therein. The slots extend into the discrete protuberance. Likewise, the paper made on this forming wire has a high basis weight essentially continuous network and discrete low basis weight regions corresponding to the discrete protuberances. Each low basis weight region has at least one high basis weight peninsular segment corresponding to the slot in the protuberance.

26 Claims, 6 Drawing Sheets

PAPER HAVING PENNINSULAR SEGMENTS

FIELD OF THE INVENTION

This invention relates to tissue paper, particularly to through air dried tissue paper, and more particularly to through air dried tissue paper having relatively large discrete low density domes.

BACKGROUND OF THE INVENTION

Paper products are a staple of every day life. Paper products are used as bath tissue, facial tissue, paper toweling, table napkins, etc. Such paper products are made by depositing a slurry of cellulosic fibers in an aqueous carrier from a headbox. The aqueous carrier is removed, leaving the cellulosic fibers to form an embryonic web and dried to form a paper sheet. The cellulosic fibers may be dried conventionally, i.e., using press felts, or dried by through air drying.

Particularly preferred through air drying utilizes a through air drying belt having an essentially continuous network made of a photosensitive resin with discrete deflection conduits therethrough. The essentially continuous network provides an imprinting surface which densifies a corresponding essentially continuous network into the paper being manufactured. The discrete, isolated deflection conduits of the through air drying belt forms domes in the paper. The domes are low density regions in the paper and provide caliper, bulk, and softness for the paper. Through air drying on a photosensitive resin belt has numerous advantages, as illustrated by the commercially successful Bounty paper towel and Charmin Ultra bath tissue, products, both sold by the assignee of the present invention.

It has been found that paper made on such a belt according to commonly assigned U.S. Pat. No. 4,637,859 issued Jan. 20, 1987 to Trokhan, the disclosure of which is incorporated herein by reference, has the advantageous property that the size of the domes is directly related to the extensibility of the resulting paper. Desirable and relatively greater extensibilities can be obtained from a relatively coarser pattern of larger domes in the paper.

However, with the benefit of the relatively greater extensibility gained from the coarse pattern of larger domes comes a drawback. Particularly, as the domes become larger, and appear coarser, the visual impression of softness is diminished. Therefore, one must choose between two desirable attributes—relatively greater extensibility or a relatively softer appearance.

Accordingly, it is an object of this invention to decouple these two properties, i.e., a soft appearance and extensibility, which were interrelated in the prior art. It is further an object of this invention to provide a through air dried paper having both relatively large discrete domes, and having a soft appearance.

SUMMARY OF THE INVENTION

The invention comprises a paper web. The paper web has an essentially continuous network region and a first plurality of domes dispersed throughout the network region. The network region has a relatively high density compared to the domes. A second plurality of peninsular segments extends from the essentially continuous network region into the domes.

In another embodiment, the invention comprises a papermaking belt which may be used for through air drying a paper web. The papermaking belt comprises a reinforcing structure and a framework. The framework has a patterned continuous network surface defining a plurality of discrete deflection conduits. A second plurality of peninsular segments extends from the network surface into the deflection conduits.

In yet another embodiment, the invention may comprise a papermaking belt useful as a forming wire. The papermaking belt may have a reinforcing structure and a plurality of discrete protuberances extending outwardly from the reinforcing structure. Each discrete protuberance has at least one slot extending therein from the reinforcing structure. The protuberances and slots produce a like pattern of low and high basis weights respectively in the resulting paper web.

Figure 1:
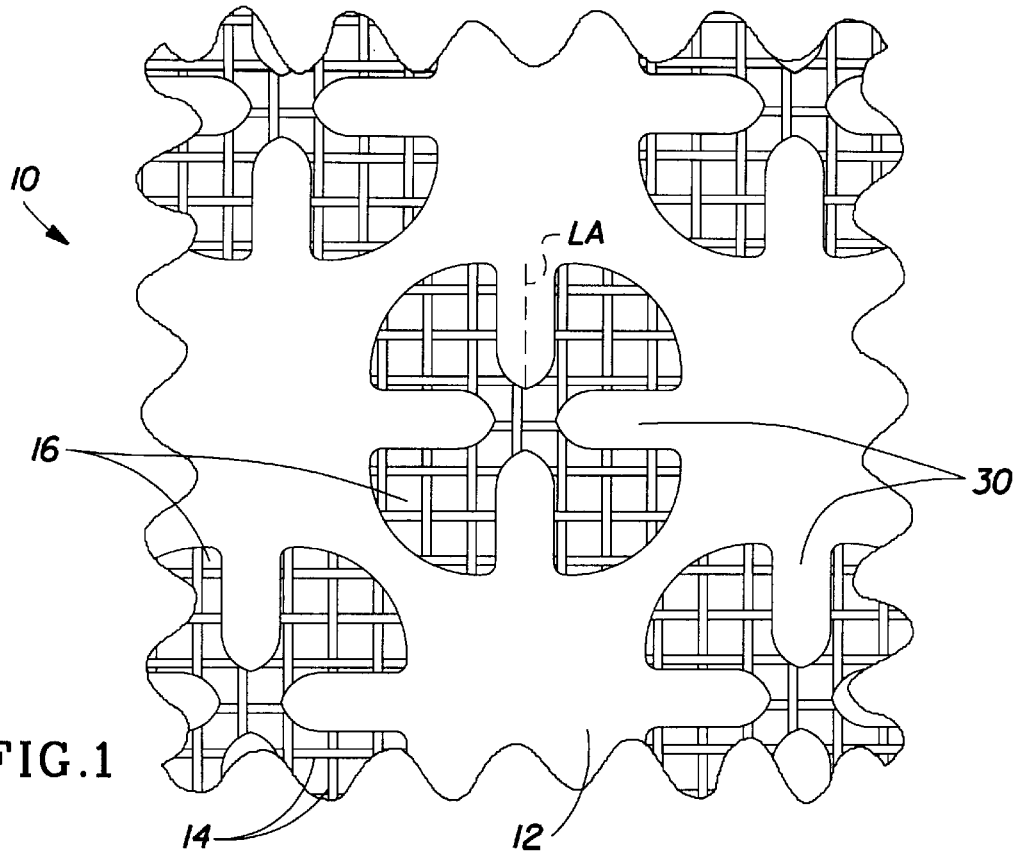
FIG. 1 is a fragmentary top plan view of a belt made according to the present invention.
Figure 2:
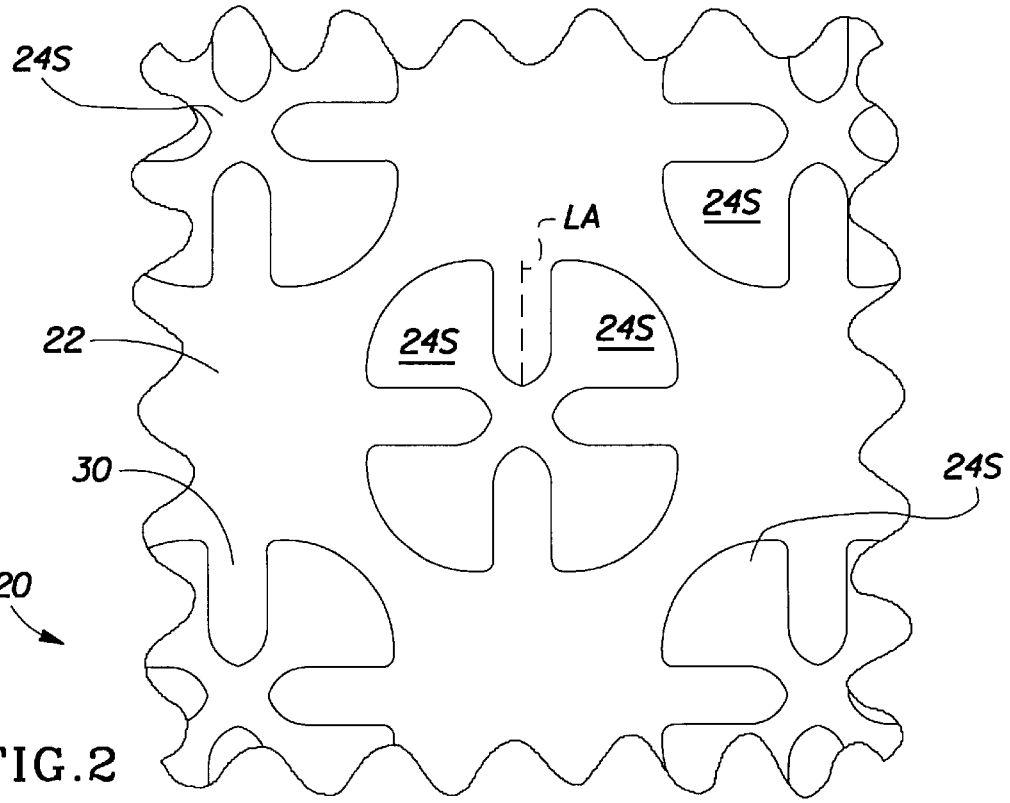
FIG. 2 is a fragmentary top plan view of the paper made on the belt of FIG. 1.

It is to be understood the paper of FIG. 2 corresponds to the belt of FIG. 1. It will similarly be understood that paper corresponding to the belts of FIGS. 3, 4, 5, 6, and 7 can likewise be made, as is recognized by one of ordinary skill in the art.

Figure 3:
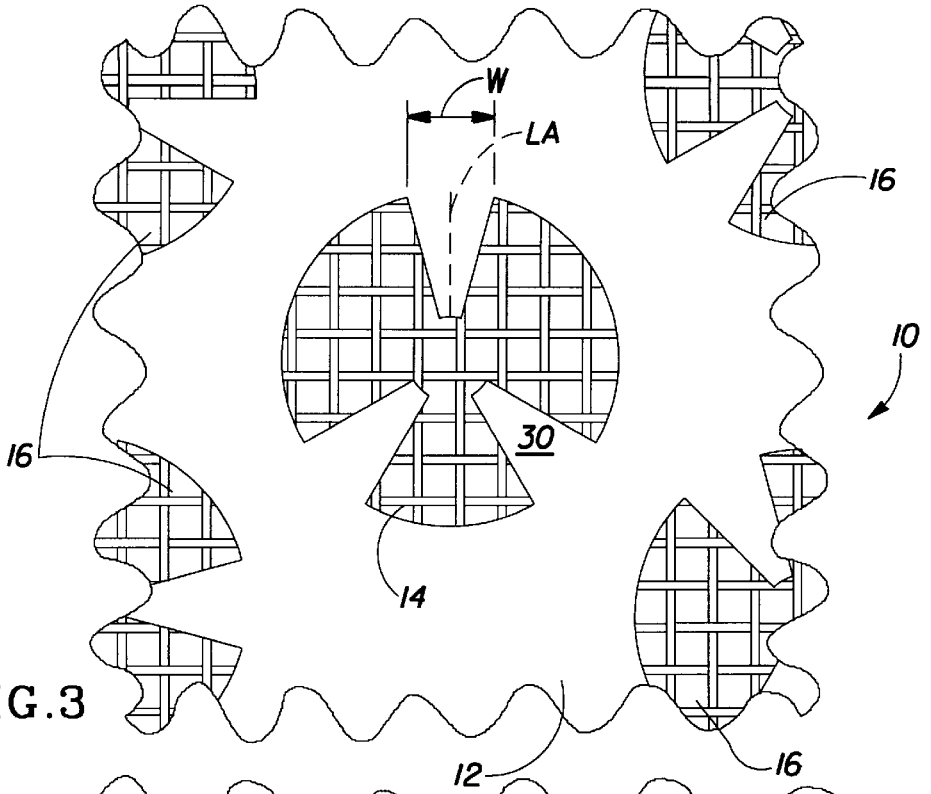

FIG. 3 is a fragmentary top plan view of a belt made according to the present invention having tapered peninsular segments arranged to form tridents.

Figure 4:
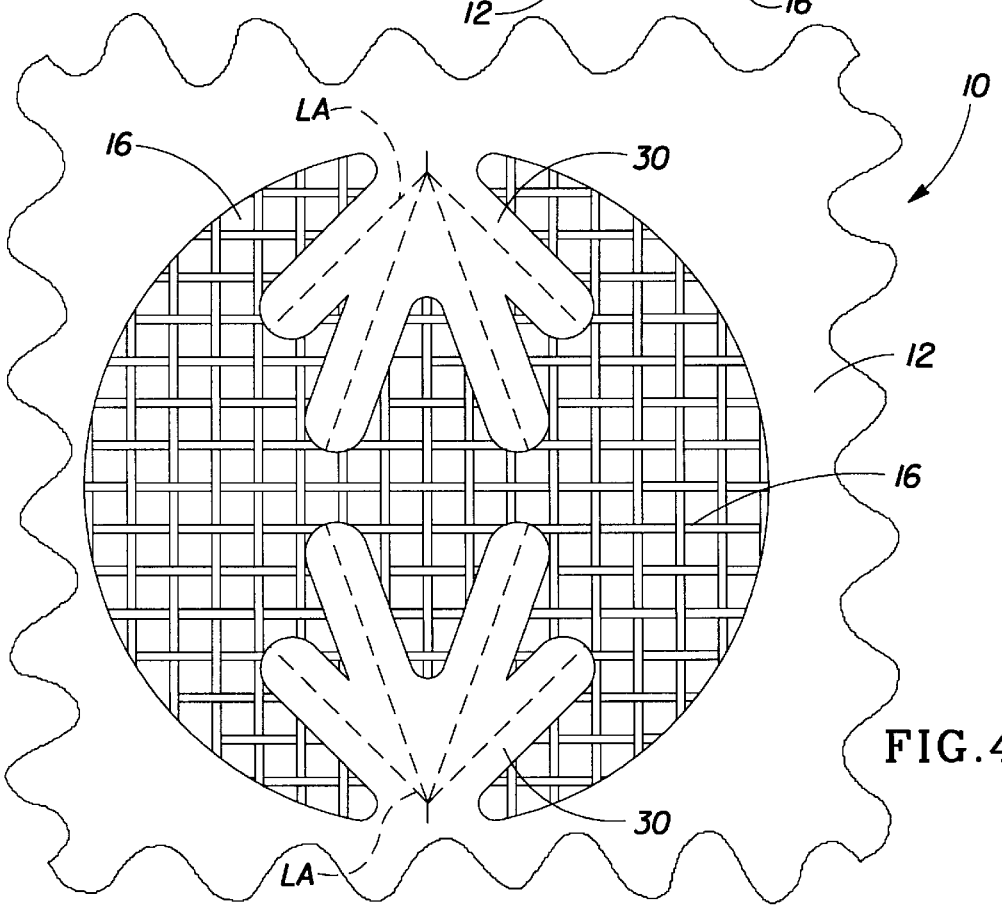

FIG. 4 is a fragmentary top plan view of a belt according to the present invention having peninsular segments which fork into radially spaced apart distal ends and having a common proximal end, the proximal ends being shown both contiguous and spaced away from the essentially continuous network.

Figure 5:
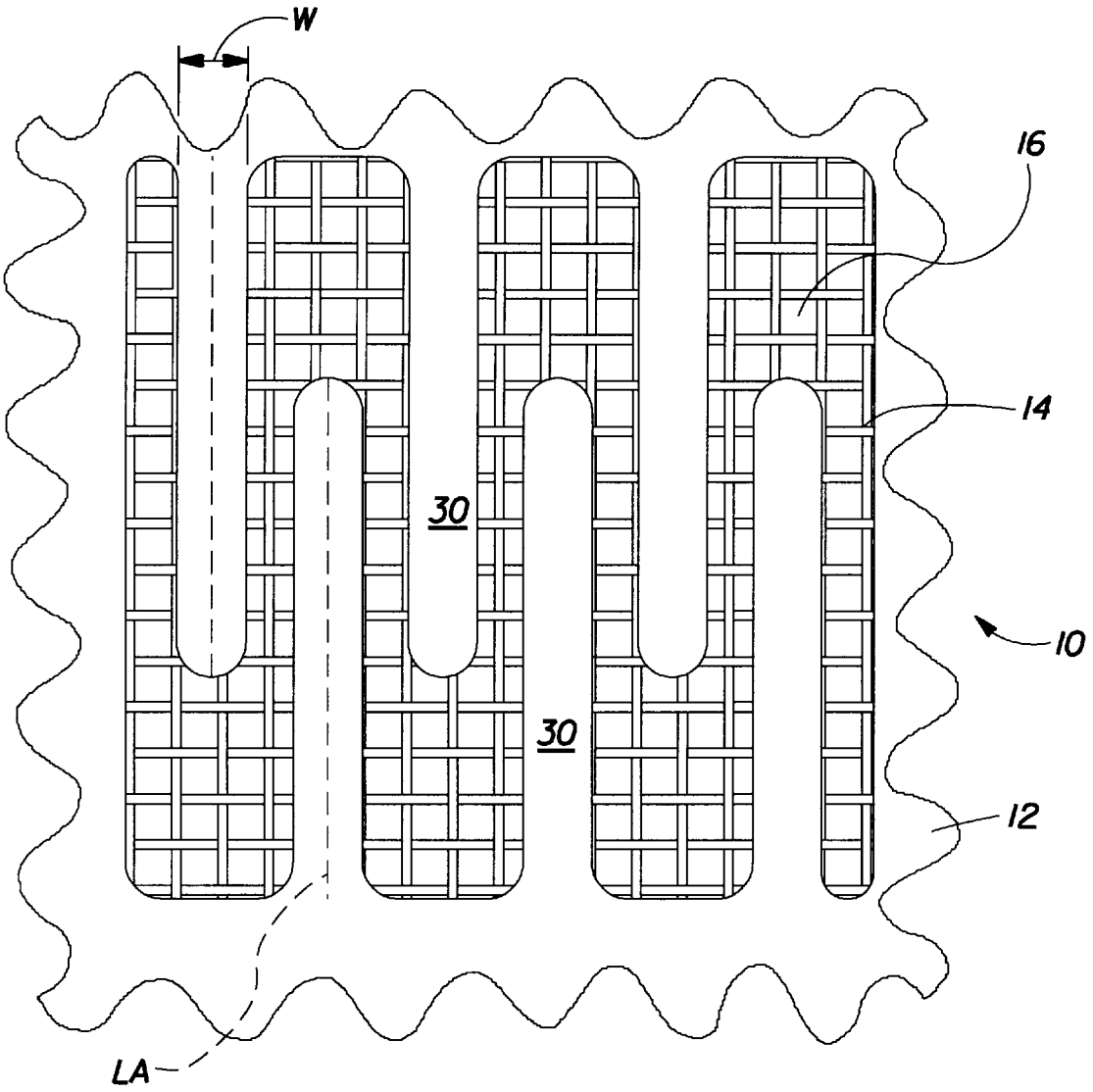

FIG. 5 is a fragmentary top plan view of a belt according to the present invention having interlaced peninsular segments.

Figure 6:
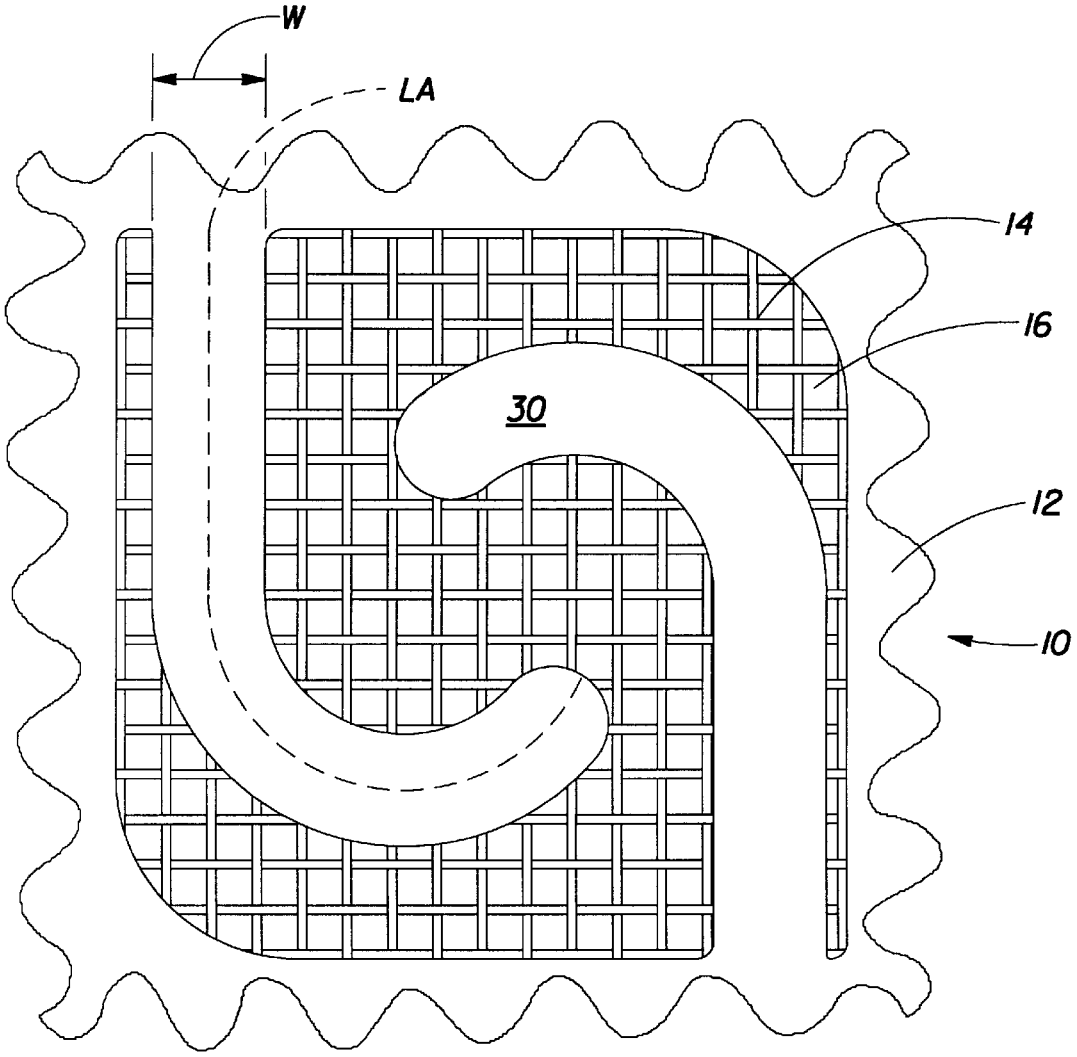

FIG. 6 shows a fragmentary top plan view of a papermaking belt according to the present invention having curved peninsular segments.

Figure 7:
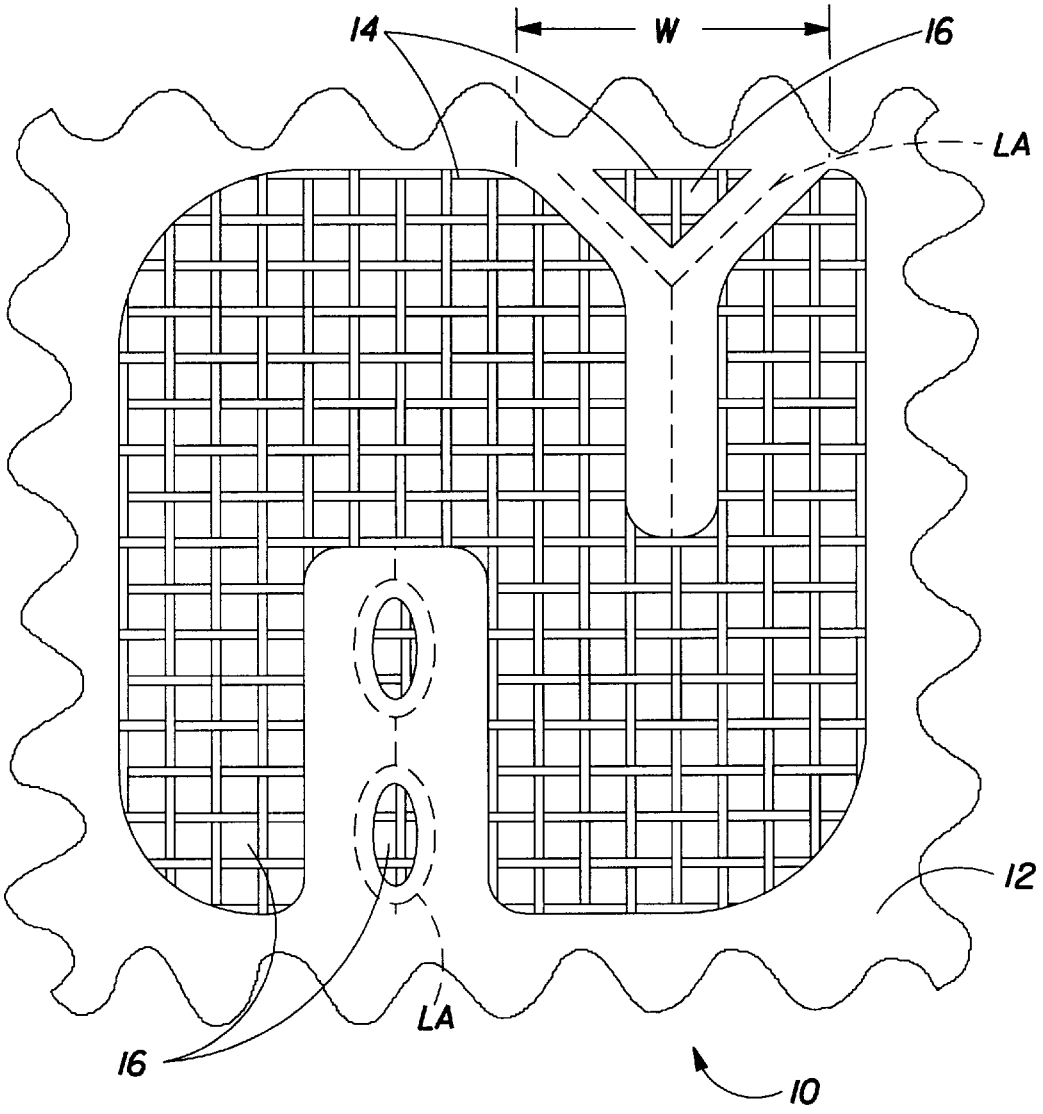

FIG. 7 is a top plan fragmentary view of a papermaking belt according to the present invention having parallel, foraminous peninsular segments, one with a forked longitudinal axis and one with a bifurcated longitudinal axis.

Figure 8:
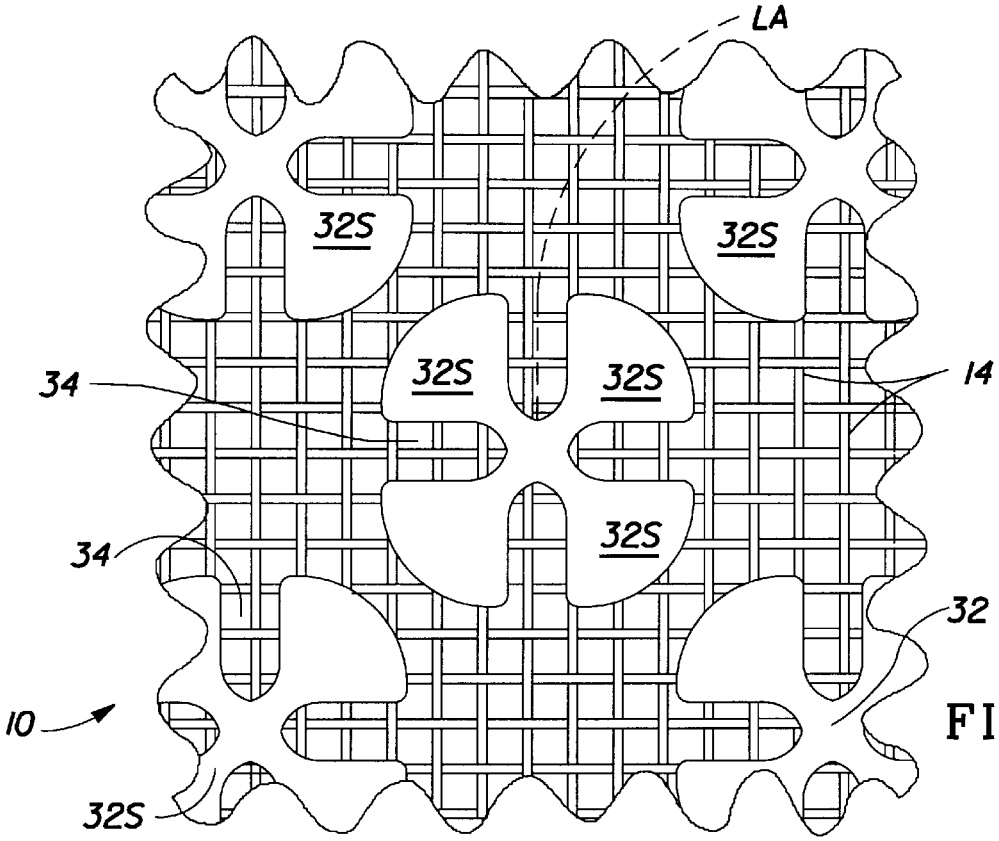

FIG. 8 is a top plan fragmentary view of a belt inverse to that shown in FIG. 1 and having discrete protuberances in place of the deflection conduits of the belt in FIG. 1.

It is to be understood that belts inverse to those shown in FIGS. 3, 4, 5, 6, and 7 can likewise be made without departure from the spirit and scope of the claimed invention.

Figure 9:
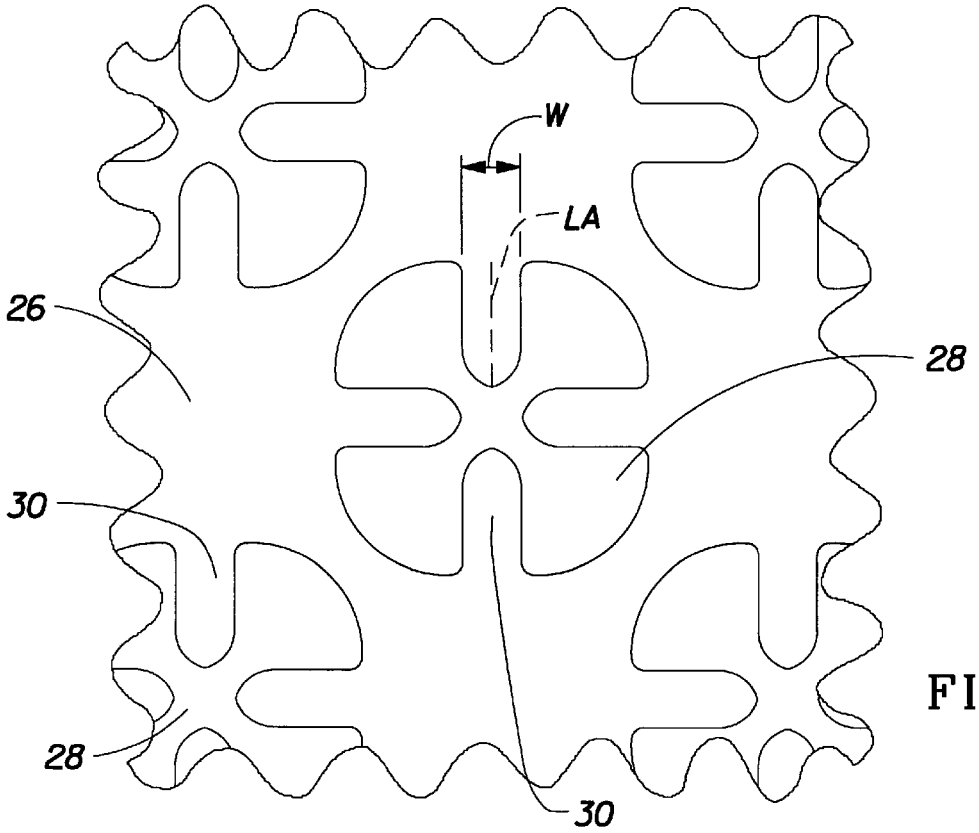

FIG. 9 is a fragmentary top plan view of the paper made on the forming wire of FIG. 8.

DETAILED DESCRIPTION OF THE INVENTION

Referring to FIG. 1, the belt 10 according to the present invention is useful for through air drying. The belt 10 comprises two primary components: a framework 12 and a reinforcing structure 14. The framework 12 is preferably a cured polymeric photosensitive resin. The framework 12 and belt 10 have a first surface which defines the paper contacting side of the belt 10 and an opposed second surface oriented towards the papermaking machine on which the belt 10 is used.

Preferably the framework 12 defines a predetermined pattern, which imprints a like pattern onto the paper 20 of the invention. A particularly preferred pattern for the framework 12 is an essentially continuous network, as defined in the previously incorporated U.S. Pat. No. 4,637,859. It will be recognized that other patterns are suitable as well, as disclosed in commonly assigned U.S. Pat. No. 4,514,345 issued Apr. 30, 1985 to Johnson et al., and U.S. Pat. No. 5,328,565, issued Jul. 12, 1994 to Rasch et al., the disclosures of which are incorporated herein by reference. If the preferred essentially continuous network pattern is selected, deflection conduits 16 will extend between the first surface and the second surface. The essentially continuous network surrounds and defines the deflection conduits 16.

The papermaking belt 10 according to the present invention is macroscopically monoplanar. The plane of the papermaking belt 10 defines its X-Y directions. Perpendicular to the X-Y directions and the plane of the papermaking belt 10 is the Z-direction of the belt 10. Likewise, the paper 20 according to the present invention can be thought of as macroscopically monoplanar and lying in an X-Y plane. Perpendicular to the X-Y directions and the plane of the paper 20 is the Z-direction of the paper 20.

The first surface of the belt 10 contacts the paper 20 carried thereon. The first surface of the belt 10 may imprint a pattern onto the paper 20 corresponding to the pattern of the framework 12.

The second surface of the belt 10 is the machine contacting surface of the belt 10. The second surface may be made with a backside network having passageways therein which are distinct from the deflection conduits 16. The passageways provide irregularities in the texture of the backside of the second surface of the belt 10. The passageways allow for air leakage in the X-Y plane of the belt 10, which leakage does not necessarily flow in the Z-direction through the deflection conduits 16 of the belt 10. A backside texture may be imparted to the belt 10 according to the disclosure, incorporated herein by reference, of commonly assigned U.S. Pat. No. 5,554,467, issued Sep. 10, 1996, to Trokhan et al.

The second primary component of the belt 10 according to the present invention is the reinforcing structure 14. The reinforcing structure 14, like the framework 12, has a first or paper facing side and a second or machine facing surface opposite the paper facing surface. The reinforcing structure 14 is primarily disposed between the opposed surfaces of the belt 10 and may have a surface coincident the backside of the belt 10. The reinforcing structure 14 provides support for the framework 12. The reinforcing component is typically woven, as is well known in the art. The portions of the reinforcing structure 14 registered with the deflection conduits 16 prevent fibers used in papermaking from passing completely through the deflection conduits 16 and thereby reduces the occurrences of pinholes. If one does not wish to use a woven fabric for the reinforcing structure 14, a nonwoven element, screen, net, or a plate having a plurality of holes therethrough may provide adequate strength and support for the framework 12 of the present invention. A suitable reinforcing structure 14 may be made according to commonly assigned U.S. Pat. No. 5,496,624 issued Mar. 5, 1996, to Stelljes et al., the disclosure of which is incorporated herein by reference.

The belt 10 having peninsular segments 30 according to the present invention may be made according to the process disclosed in the aforementioned Johnson '345 or Trokhan '289 patents. The present invention requires the belt making process to have a mask with transparent regions corresponding to the desired peninsular segments 30. The resin which forms the framework 14 is cured by actinic radiation which passes through the transparent regions of the mask as described in the aforementioned patents incorporated herein by reference.

Referring to FIG. 2, the paper 20 of the present invention has two primary regions. The first region comprises an imprinted region 22. The imprinted region 22 preferably comprises an essentially continuous network. The continuous network of the first region of the paper 20 is made on the essentially continuous framework 12 of the papermaking belt 10 described above and will generally correspond thereto in geometry and be disposed very closely thereto in position during papermaking.

The second region of the paper 20 comprises a plurality of domes 24 dispersed throughout the imprinted network region 22. The domes 24 generally correspond in geometry, and during papermaking in position, to the deflection conduits 16 in the belt 10 described above. The domes 24 protrude outwardly from the essentially continuous network region 22 of the paper 20, by conforming to the deflection conduits 16 during the papermaking process. By conforming to the deflection conduits 16 during the papermaking process, the fibers in the domes 24 are deflected in the Z-direction between the paper facing surface of the framework 12 and the paper facing surface of the reinforcing structure 14.

Preferably the domes 24 are discrete. Each dome 24 has a major axis corresponding to the greatest dimension of the dome 24 and a minor axis perpendicular thereto. Likewise, the deflection conduits 16 have major and minor axes.

Without being bound by theory, it is believed the domes 24 and essentially continuous network regions of the paper 20 may have generally equivalent basis weights. By deflecting the domes 24 into the deflection conduits 16, the density of the domes 24 is decreased relative to the density of the essentially continuous network region 22. Moreover, the essentially continuous network region 22 (or other pattern as may be selected) may later be imprinted as, for example, against a Yankee drying drum. Such imprinting increases the density of the essentially continuous network region 22 relative to that of the domes 24. The resulting paper 20 may be later embossed as is well known in the art.

The papermaking belt 10 and paper 20 according to the present invention may be made according to any of commonly assigned U.S. Pat. No. 4,514,345, issued Apr. 30, 1985 to Johnson et al.; U.S. Pat. No. 4,528,239, issued Jul. 9, 1985 to Trokhan; U.S. Pat. No. 4,529,480, issued Jul. 16, 1985 to Trokhan; U.S. Pat. No. 5,245,025, issued Sep. 14, 1993 to Trokhan et al.; U.S. Pat. No. 5,275,700, issued Jan. 4, 1994 to Trokhan; U.S. Pat. No. 5,328,565, issued Jul. 12, 1994 to Rasch et al.; U.S. Pat. No. 5,334,289, issued Aug. 2, 1994 to Trokhan et al.; U.S. Pat. No. 5,364,504, issued Nov. 15, 1995 to Smurkoski et al.; and U.S. Pat. No. 5,527,428, issued Jun. 18, 1996 to Trokhan et al. the disclosures of which applications are incorporated herein by reference.

In yet another embodiment, the reinforcing structure 14 may be a felt, also referred to as a press felt as is used in conventional papermaking without through air drying. The framework 12 may be applied to the felt reinforcing structure 14 as taught by commonly assigned U.S. Pat. No. 5,556,509, issued Sep. 17, 1996 to Trokhan et al. and PCT Application WO 96/00812, published Jan. 11, 1996 in the names of Trokhan et al., the disclosures of which patent and application are incorporated herein by reference.

Examining the belt 10 of the present invention in more detail and with continuing reference to FIG. 1, the belt 10 according to the present invention further comprises a plurality of peninsular segments 30. The number of segments 30 in this plurality may be the same as, but is preferably greater than, the number of deflection conduits 16 in the belt 10, or a like portion of the belt 10 having deflection conduits 16 with peninsular segments 30.

The peninsular segments 30 have a proximal end juxtaposed with, and preferably contiguous with the essentially continuous network of the framework 12. The peninsular segments 30 extend outwardly along a longitudinal axis LA from the proximal end to a distal end remote from the proximal end and which is preferably interior to the deflection conduits 16.

Referring to FIGS. 1, 2 and 8, the peninsular segments 30 of the paper 20 according to the present invention, and the peninsular segments 30 of the belt 10 according to the present invention meet both of the following criteria, in order to be considered a peninsular segment 30 and be distinguishable over normal, predetermined and random variations in the contours of the network region of the paper 20 or the essentially continuous framework 12 of the belt 10, and particularly variations in that portion of the network region adjacent the domes 24 or deflection conduits 16:

1) the peninsular segment 30 has a distal end which is freestanding and interior to the dome 24 of the paper 20 or the deflection conduit 16 of the belt 10, or the discrete protuberance 32 of the belt 10, as the case may be; and
2) either:
   a) the longitudinal axis LA of the peninsular segment 30 has a length of at least 25 percent of the minor axis of the dome 24 (if in paper 20) or the minor axis of the deflection conduit 16 or discrete protuberance 32 (if in a belt 10); or
   b) the longitudinal axis LA of the peninsular segment 30 has a length of at least 10 percent of the minor axis of the dome 24 (if in paper 20) or the minor axis of the deflection conduit 16 or discrete protuberance 32 (if in a belt 10) and the peninsular segment 30 has an aspect ratio, as defined below, of at least 1.

The aspect ratio of the peninsular segment 30 is the ratio of the length of the longitudinal axis LA to the width W of the peninsular segment 30. As discussed above, the longitudinal axis LA of the peninsular segment 30 is the line extending from the proximal end to the distal end of that peninsular segment 30 and generally laterally centered within the width W of that peninsular segment 30. The width W is measured perpendicular to the longitudinal axis LA.

For purposes of determining the aspect ratio, the width W is measured at both the proximal end and the midpoint of that peninsular segment 30. The midpoint of the peninsular segment 30 lies on the longitudinal axis LA, halfway between the proximal and distal ends of the peninsular segment 30. The aforementioned aspect ratio criterion is satisfied by the width measured at either the proximal end or midpoint of the peninsular segment 30.

Referring again to FIG. 2, the paper 20 according to the present invention likewise has a first plurality of domes 24 and a second plurality of peninsular segments 30, the second plurality preferably being greater than the first plurality. Each peninsular segment 30 extends from the essentially continuous network into one of the domes 24. Preferably if there is only one peninsular segment 30 it extends at least halfway through the dome 24, so as to visually subdivide the dome 24 into smaller subdomes 24S.

More preferably, there are a plurality of peninsular segments 30 extending into each dome 24. The domes 24 having a plurality of peninsular segments 30 may, for example, be divisible into subdomes 24S comprising three tridents by three peninsular segments 30, four quadrants by four peninsular segments 30, and up to N subdomes 24S by N peninsular segments 30. Any desired number of peninsular segments 30 may be utilized, limited only by the size and resolution of the pattern in the papermaking belt 10 of the present invention.

If a plurality of peninsular segments 30 is desired for each dome 24 in the paper 20 according to the present invention, the peninsular segments 30 are preferably equally circumferentially spaced from one another. The circumferential spacing between adjacent peninsular segments 30 is determined by the arc subtended between adjacent peninsular segments 30 along the edge of the dome 24 and which corresponds to the edge of the essentially continuous network. For example, if three peninsular segments 30 are utilized, they may be circumferentially spaced approximately 120 degrees apart. If four peninsular segments 30 are used, they are preferentially circumferentially spaced approximately 90 degrees apart, etc. The circumferential spacing is measured at the longitudinal axes LA of the peninsular segments 30.

Referring to FIG. 3, the peninsular segments 30 of the belt 10 may be tapered. Preferably, for strength, the peninsular segments 30 taper from a wider proximal end to a narrower distal end. In an alternative embodiment (not shown), the peninsular segments 30 may taper from a narrower proximal end to a wider distal end. In a variant of the latter embodiment, the peninsular segments 30 may be mushroom-shaped. It will be apparent to one of ordinary skill that the peninsular segments 30 need not monotonically taper from wider to narrower or from narrower to wider. Peninsular segments 30 having generally sinuous or undulating sides may be utilized in order to further visually subdivide the domes 24 of the paper 20 according to the present invention into smaller subdomes 24S.

Referring to FIG. 4, in another embodiment, the peninsular segment may extend from a proximal end and be divided to extend to a plurality of distal ends. Each of the distal ends is spaced apart from the other distal ends. Each of the distal ends may extend outwardly from a common proximal end. This proximal end may be contiguous with the essentially continuous network as shown in FIG. 4. Alternatively, the common proximal end may be disposed interior to the dome as also shown in FIG. 4.

Referring to FIG. 5, preferably each deflection conduit 16 has at least two peninsular segments 30. The peninsular segments 30 may have a generally common orientation, i.e., the lines defining the longitudinal axes LA of the peninsular segments 30 are preferably generally parallel. In such an arrangement, the peninsular segments 30 are considered to be generally parallel.

If the peninsular segments 30 are generally parallel one another as shown, more preferably, as shown in FIG. 5, the parallel peninsular segments 30 are offset from one another. In such an arrangement, more preferably each peninsular segment 30 extends at least halfway through the deflection conduit 16 or dome 24, so that the peninsular segments 30 appear to be interlaced. This arrangement further visually subdivides the deflection conduit 16 or domes 24 into even smaller appearing sub-deflection conduits 16 or subdomes 24S. Alternatively, the interlaced peninsular segments 30 may be skewed relative to other peninsular segments 30.

Referring to FIG. 6, curved peninsular segments 30 may be utilized. If multiple curved peninsular segments 30 are utilized, they may also be interlaced or have portions of which are interlaced, as illustrated in FIG. 6.

Referring to FIG. 7, the peninsular segments 30 may be foraminous. As used herein, a peninsular segment 30 is considered to be foraminous if there is a deflection conduit 16 therethrough. It will be apparent that foraminous peninsular segments 30 may also be tapered, as in the embodiment of FIG. 3. It will further be apparent the longitudinal axis LA of a foraminous peninsular segment 30 may be forked or bifurcated, to accommodate a deflection conduit 16 disposed within the peninsular segment 30.

In another embodiment of the present invention discussed below, the paper 20 according to the present invention may have an essentially continuous network 26 of relatively high basis weight and discrete regions 28 of relatively low basis weight. The discrete regions 28 of relatively low basis weight may, according to the present invention, have one or more high basis weight peninsular segments 30 extending into the discrete regions of relatively low basis weight 26 from the high basis weight essentially continuous network 28.

To make such a paper 20, the belt 10 according to the present invention may be a forming wire as is well known in the art. As illustrated in FIG. 8, if the belt 10 is to be used as a forming wire, the belt 10 may have discrete protuberances 32.

Referring to FIGS. 8–9, each protuberance 32 in the belt 10 has one or more peninsular slots 34 extending within the X-Y plane. The slots 34 divide the protuberances 32 into a like number of subprotuberances 32S. This division provides the advantage that the paper 20 made thereon enjoys economization of fibers provided by the protuberances 32, yet does not suffer an undue loss of opacity or, prophetically, other mechanical properties, as a result of such fiber economization, when used in conjunction with relatively large low basis weight regions 28.

The resulting paper 20 will have high basis weight regions 26 with high basis weight peninsular segments 30 and low basis weight regions 28 corresponding to the discrete protuberances 32. The high and low basis weight regions 26, 28 of the paper 20 may be thought of as comprising an essentially continuous network having a first high basis weight region 26. A plurality of discrete low basis weight regions 28 is disposed within the essentially continuous network region 26. The discrete low basis weight regions 28 have a second basis weight which is less than the first basis weight of the essentially continuous network region 26. The first basis weight of the essentially continuous network high basis weight region 26 is greater than the second basis weight of the discrete basis weight regions 28.

Additionally, as noted above, the peninsular segments 30 extend from the essentially continuous network high basis weight region 26 into the discrete low basis weight regions 28. The peninsular segments 30 have a basis weight greater than that of the low basis weight discrete regions 28, and preferably a basis weight generally equivalent that of the high basis weight essentially continuous network region 26.

The present invention having the peninsular segments 30 works well with paper 20 having domes 24, or a belt 10 having deflection conduits or 16 or discrete protuberances 32 in a pattern size ranging from 5 to 500 per inch and preferably 100 to 250 per inch. Of course, the present invention is more useful with generally larger sized patterns.

If desired, the present invention may also be used with a semicontinuous pattern. Semicontinuous patterns are disclosed in commonly assigned U.S. Pat. No. 5,628,876, issued May 13, 1997, to Ayers et al., the disclosure of which is incorporated herein by reference. The peninsular segments 30 of the present invention may be used with the belt 10 and the paper 20 of Ayers et al.

It will be recognized that many combinations of the foregoing and many other variations according to the present invention are feasible, all of which are covered by the scope of the appended claims.

What is claimed is:

1. A paper web comprising:

a patterned imprinted region;

a plurality of discrete domes, said domes being dispersed throughout and encompassed by said imprinted region, said imprinted region having a higher density than said domes; and a plurality of peninsular segments, each said peninsular segment extending from said imprinted region into one of said domes.

2. A paper web according to claim 1 wherein said peninsular segment extends at least halfway through said dome.

3. A paper web according to claim 2 wherein said peninsular segment extends from a proximal end contiguous with said essentially continuous network and is divided to extend to a plurality of distal ends, each of said distal ends being spaced apart from other said distal ends.

4. A paper web according to claim 2 wherein said peninsular segments are tapered.

5. A paper web according to claim 4 wherein said peninsular segments extend from a proximal end contiguous with said imprinted region to a distal end disposed within said dome, each of said peninsular segments tapering from a wider proximal end to a distal end narrower than said proximal end.

6. A paper web according to claim 5 wherein said peninsular segments monotonically taper from a proximal end to a distal end which is narrower than said proximal end.

7. A paper web according to claim 1 having three peninsular segments extending to a plurality of said domes, said domes being divisible into three tridents by said three peninsular segments.

8. A paper web according to claim 1 having four peninsular segments extending to a plurality of said domes, said domes being divisible into four quadrants by said four peninsular segments.

9. A paper web according to claim 8 wherein said four peninsular segments are circumferentially spaced approximately 90 degrees from one another.

10. A paper web according to claim 1 wherein each said dome has a plurality of peninsular segments, each said peninsular segment extending from a common proximal end contiguous with said imprinted region, each of said distal ends being spaced apart from other said distal ends.

11. A paper web comprising an imprinted patterned essentially continuous network region, and a plurality of discrete domes, said domes being dispersed throughout said imprinted network region, said imprinted network region having a higher density than said domes, said paper web further comprising a plurality of peninsular segments extending into said domes, said peninsular segments being circumferentially spaced apart, each said peninsular segment extending from a proximal end contiguous with said essentially continuous network to a distal end, said distal end being disposed within said dome, said plurality of peninsular segments subdividing said dome into a plurality of subdomes.

12. A paper web according to claim 11 wherein said plurality of peninsular segments comprises at least two adjacent peninsular segments, said peninsular segments being circumferentially spaced apart at least 90 degrees.

13. A paper web according to claim 12 wherein at least one of said peninsular segments extends at least halfway through said dome.

14. A paper web according to claim 12 wherein said orientations of at least two said peninsular segments are generally parallel.

15. A paper web according to claim 14 wherein said peninsular segments are interlaced.

16. A paper web comprising an essentially continuous network having a first basis weight, a plurality of discrete regions disposed within said essentially continuous network, said discrete regions having a second basis weight, said first basis weight being greater than said second basis weight, said paper web further comprising a plurality of peninsular segments, each said peninsular segment extending from said essentially continuous network having said first basis weight into one of said discrete regions, said peninsular segments having a basis weight greater than that of said discrete regions.

17. A paper web according to claim 16 wherein said peninsular segments have a basis weight substantially equivalent that of said essentially continuous network.

18. A paper web according to claim 17 wherein said peninsular segment extends at least half way through said discrete region.

19. A paper web according to claim 17 comprising a plurality of peninsular segments extending into each said discrete region, each said peninsular segment extending from said essentially continuous network into said discrete region.

20. A paper web according to claim 19 wherein said discrete region is divisible into N different subregions.

21. A paper web according to claim 20 wherein said peninsular segments are equally circumferentially spaced apart.

22. A paper web according to claim 20 wherein said peninsular segments monotonically taper from a proximal end to a distal end which is narrower than said proximal end.

23. A paper web according to claim 17 comprising at least two peninsular segments extending into one said discrete region, said at least two peninsular segments being interlaced.

24. A paper web according to claim 16 wherein said peninsular segment extends from a proximal end contiguous with said essentially continuous network and is divided into a plurality of distal ends, each of said distal ends being spaced apart from other said distal ends.

25. A paper web comprising:

a patterned semicontinuous imprinted network region;

a plurality of semicontinuous domes, said domes being dispersed throughout said semicontinuous imprinted network region, said imprinted network region having a higher density than said domes; and a plurality of peninsular segments, each said peninsular segments extending from said imprinted network region into one of said domes.

26. A paper web according to claim 25 wherein at least some of said peninsular segments in said plurality extend at least halfway through said semicontinuous dome.

* * * * *